US005350018A

United States Patent [19]

Sorem et al.

[11] Patent Number: 5,350,018

[45] Date of Patent: Sep. 27, 1994

[54] WELL TREATING SYSTEM WITH PRESSURE READOUT AT SURFACE AND METHOD

[75] Inventors: Robert M. Sorem, Sugar Land, Tex.; David M. Eslinger, Broken Arrow, Okla.; Hubertus V. Thomeer; Darrin Willauer, both of Houston, Tex.; Sarmad Adnan, Alvin, Tex.

[73] Assignee: Dowell Schlumberger Incorporated, Sugar Land, Tex.

[21] Appl. No.: 133,631

[22] Filed: Oct. 7, 1993

[51] Int. Cl.[5] ..... E21B 33/124; E21B 33/127; E21B 47/06; E21B 47/12

[52] U.S. Cl. ..... 166/250; 166/64; 166/66; 166/187; 166/191; 166/384; 73/151

[58] Field of Search ..... 166/250, 264, 65.1, 166/64, 66, 113, 384, 385, 387, 305.1, 191, 187, 240; 73/151

[56] References Cited

U.S. PATENT DOCUMENTS

| | | | |
|---|---|---|---|
| 3,876,000 | 4/1975 | Nutter | 166/187 X |
| 3,876,003 | 4/1975 | Kisling, III | 166/187 X |
| 4,320,800 | 3/1982 | Upchurch | 166/106 |
| 4,535,843 | 8/1985 | Jageler | 166/250 |
| 4,635,717 | 1/1987 | Jageler | 166/250 |
| 4,838,349 | 6/1989 | Berzin | 166/187 |
| 4,898,236 | 2/1990 | Sask | 166/65.1 |
| 4,903,231 | 4/1990 | Muller et al. | 166/250 |

*Primary Examiner*—Stephen J. Novosad
*Attorney, Agent, or Firm*—Stephen A. Littlefield

[57] ABSTRACT

A well treating tool string run on coiled tubing and having packers to isolate a zone to be treated in response to operation of a selector valve, pressure and temperature transducers in the tool string and a telemetry system which samples the measurements made by the transducers, an electrical conductor cable extending from the telemetry system up to the surface through the coiled tubing and to the inner end thereof on its storage reel, and a surface telemetry, data processing and display system that sends and receives encoded signals to and from the downhole telemetry system from which temperature and pressure values can be read out on the surface display in real time as the treating operation proceeds.

22 Claims, 7 Drawing Sheets

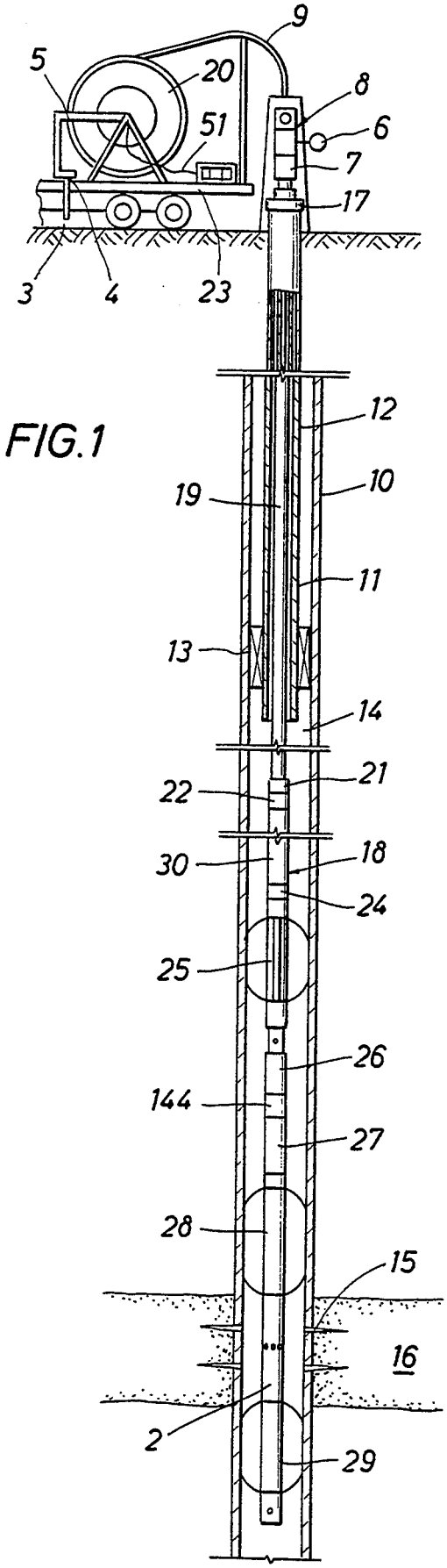
FIG.1
FIG. 2A
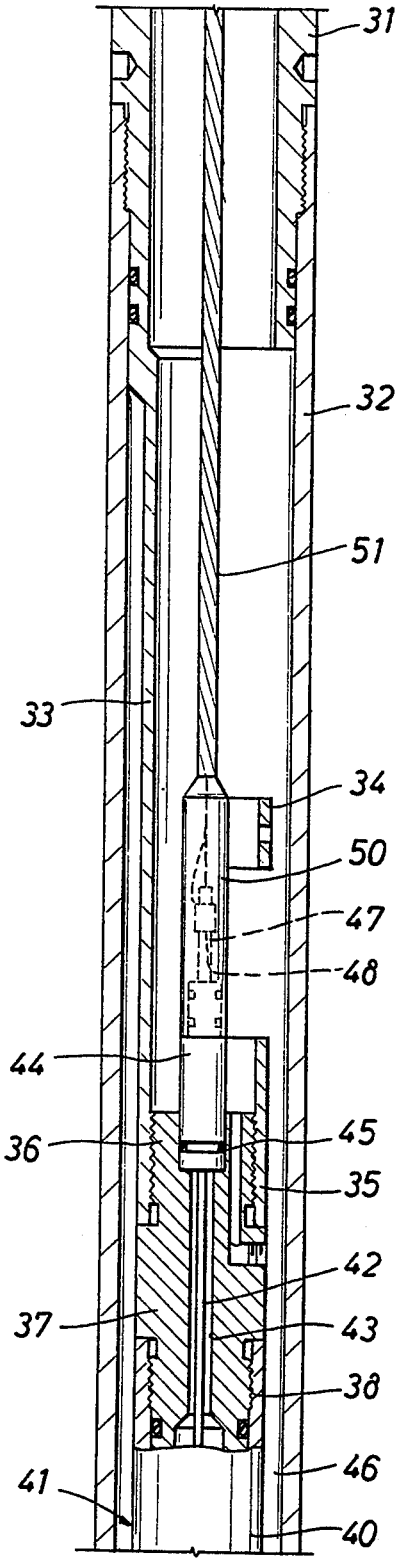

FIG. 2B
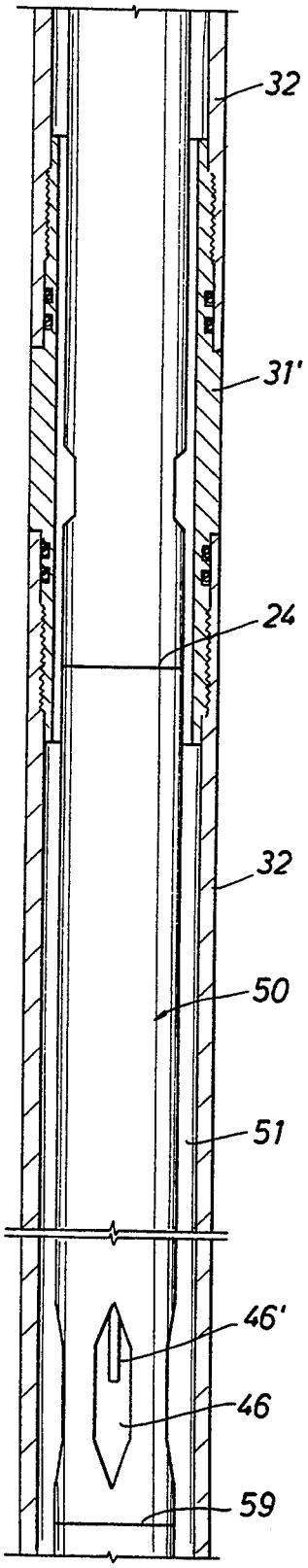
FIG. 2C
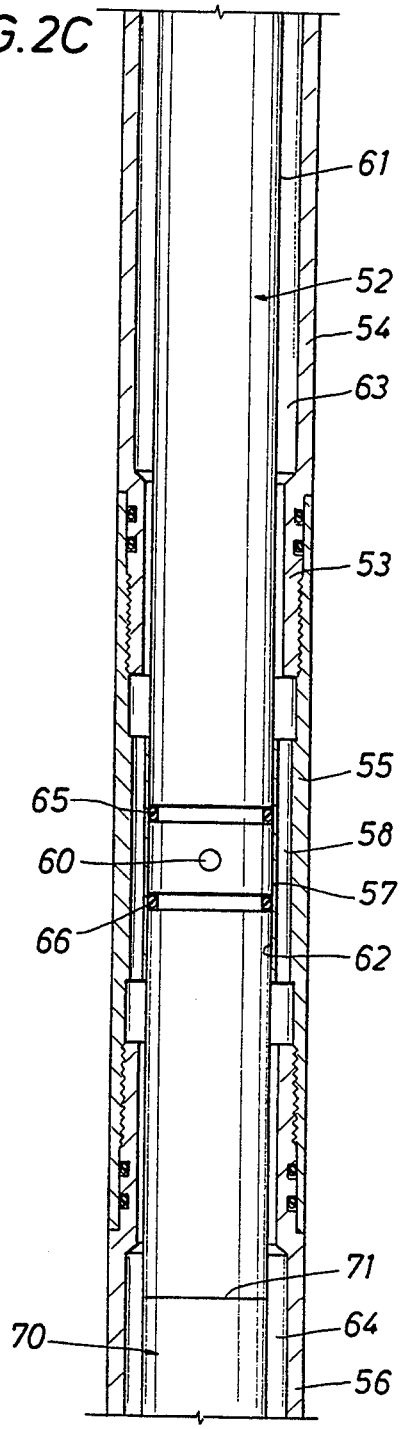
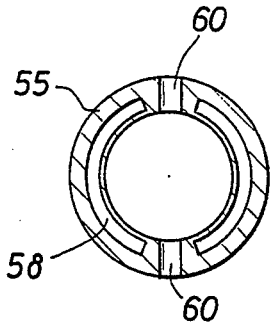
FIG. 3

WELL TREATING SYSTEM WITH PRESSURE READOUT AT SURFACE AND METHOD

FIELD OF THE INVENTION

This invention relate generally to a new and improved tool string and methods for use in treating an isolated zone in a well, and particularly to a tool string run on coiled tubing and including a sensor package which monitors various pressures and other variables and enables measurements thereof to be read out at the surface in real-time.

BACKGROUND OF THE INVENTION

Coiled tubing conveyed tool strings for treating well intervals or zones are known. See for example, U.S. Pat. No. 4,913,231, Muller and Randermann, issued Apr. 3, 1990, which is incorporated herein by express reference. The running of tool strings on coiled tubing has the advantage that there are no threaded joints to be made up or broken out, so that the tools can be run much faster and at considerably less expense. U.S. Pat. No. 4,913,231 also discloses certain valve subsystems for opening and closing various ports and pressure passageways whereby inflatable packers can be expanded and retracted, and treating fluids injected into a zone that is isolated by the packers. Although such systems and subsystems represent considerable advances in the art, it would be highly useful and advantageous to have real-time surface read out of the values of certain downhole pressures, such as the pressure inside the coil tubing, hydrostatic pressure, packer inflation pressures, injection pressures, as well as other data such as downhole temperatures and the like. These measurements are significant because changing downhole well conditions during a treatment operation, which are not otherwise known at the surface without extensive calculations and assumptions, can cause unexpected failure of inflatable packers and/or tool operations. Of particular interest are inflatable packer pressure differentials to allow adjustments to be made at the surface which will maintain such differentials within design limits. Another variable of significance is the response of the reservoir rock to the treatment, which can be monitored if the pressure in the isolated zone is known so that the treatment can be adjusted to achieve optimum results. Other advantages for surface read-out of pressure as well as other variables will be apparent.

A general object of the present invention is to provide a new and improved well treating tool string and methods where various downhole measurements of interest can be made and monitored at the surface in real-time.

Another object of the present invention is to provide a new and improved well treating tool string having inflatable packers to isolate the treatment zone and where packer pressure differentials can be determined at the surface based upon real-time read-out of pressure data.

SUMMARY OF THE INVENTION

These as well as other objects are attained in accordance with the present invention through the provision of a tool string arranged to be run into a well, for example through the production tubing, on the lower end of a length of coiled tubing. The tool string includes upper and lower, normally retracted, inflatable packers which are expanded to isolate a well zone in the casing below the production tubing by applying pressure to the inside of the packer elements via the coiled tubing. The packer elements are mounted below a selector valve system that performs the necessary valving functions in response to up and down movement of the lower end of the coiled tubing, and a plurality of transducers are mounted inside a tubular body structure located above the selector valve system. The transducers are arranged with respect to ports and passages in the body structure to sense internal pressures at the lower end of the coiled tubing, inflation pressures applied to the packers, hydrostatic pressure in the well annulus above the upper packer, treatment fluid injection pressures, and the temperature of fluids in the well bore. Signals which are representative of each of these measures are made available at the surface by a transmission means such as an armored electrical cable which is positioned inside the bore of the coiled tubing prior to winding the same on its reel. The lower end of the armored cable is connected to a transmitter package at the upper end of the transducers, and the upper end of the cable extends out of the upper end of the coiled tubing via a packing gland at the inner portion of the storage reel. From there the cable is connected to a transmission module and to data processing and display units which make the down-hole measurements of pressure and temperature available at the surface in real time for information, analysis, or interpretation. When the treatment operation is completed, the packer elements are deflated so that they return to their original retracted conditions. Then the tool string is withdrawn from the well through the production tubing as the coiled tubing is wound back onto its reel. The signals which are transmitted over the armored cable can be either binary or analog, and other types of transmission methods could be used.

BRIEF DESCRIPTION OF THE DRAWINGS

The present invention has the above as well as other objects, features and advantages which will become more clearly apparent in connection with the following detailed description of a preferred embodiment in which:

FIG. 1 is a schematic view of a well treating operation using a tool string that is run on coiled tubing;

FIGS. 2A–D are longitudinal sectional views, with some parts in side elevation, of the telemetry and sensor package of the present invention;

FIG. 3 is a cross-section on line 3—3 of FIG. 2B;

DETAILED DESCRIPTION OF A PREFERRED EMBODIMENT

Figure 2D:
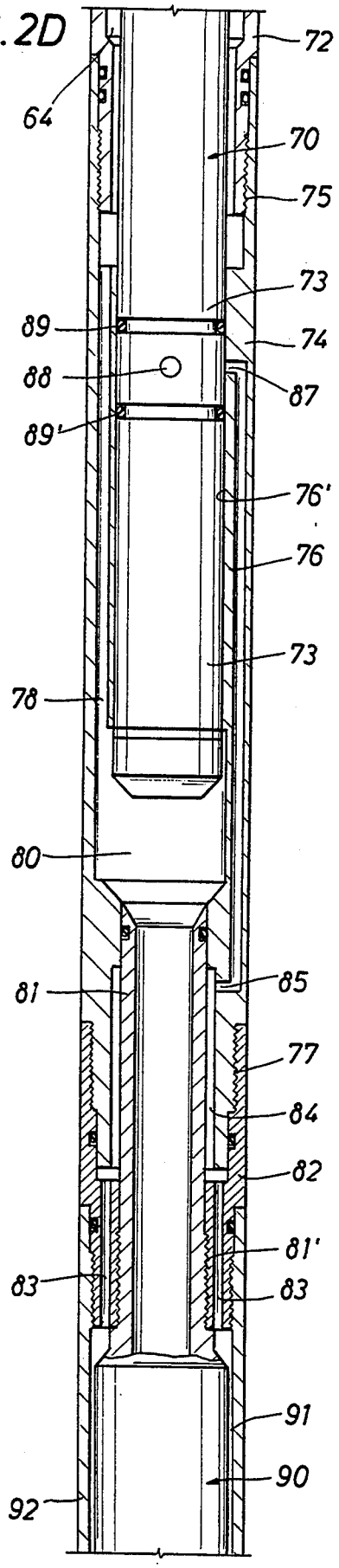

Referring initially to FIG. 1, a well environment in which the present invention typically is used includes a casing 10 that lines a well bore 11 and which has a string of lesser diameter production tubing 12 disposed therein. The tubing 12 extends from the surface down to a typical packer 13 which seals off the annulus between the tubing 12 and the casing 10 to confine the pressure in the zone 14 below the packer to the inside of the tubing 12. The casing 10 has been perforated at 15 to communicate a producing formation 16 with the bore of the casing so that fluids such as oil or gas can flow upward to the surface via the tubing 12. At the surface the production tubing 12 is hung off in a tree 17 having side outlets for conveying the produced fluids to a gathering facility (not shown).

In order to perform a well treating or other service operation in the well casing 10 below the packer 13 in a manner such that downhole pressures, temperatures and other variables are immediately available at the surface, a through-tubing tool string 18 that is constructed in accordance with the present invention is used. The use of a through-tubing tool string 18, as noted above, makes it unnecessary to remove or reinstall the production tubing 12, which otherwise would be a time-consuming and expensive procedure. However the production tubing 12 could be temporarily removed from the well, if desired. The tool string 18 is connected to the lower end of coiled tubing 19 which has the tremendous advantage over a standard tubing string having joints threaded end-to-end that no joints need be made up or broken out as the running string 19 is lowered or withdrawn. The coiled tubing 19 is wound on a reel 20 at the surface which is mounted on the bed of a truck 23. The tubing 19 goes over a guide 9 and into the top of an injector 8 which drives the tubing into and out of the well. One or more blowout preventors 7 are provided to ensure complete well control. A weight indicator gauge 6 is provided, and fluids under pressure can be pumped into the coiled tubing 19 via a line 5 which leads to the end of the innermost coil of the tubing from a pump 4 which takes fluid from a supply tank 3. A depth meter (not shown) also can be provided to inform the operator of the length of the coiled tubing 19 in the well at all times.

The tool string 18 includes a number of individual components that are connected end-to-end and which cooperate to enable various types of well service jobs to be performed. The lower end of the coiled tubing 21 is connected by a typical grapple 21 which can be connected to a check valve assembly 22 which prevents back flow of fluids up the tubing 19. The valve assembly 22 is connected to the upper end of a transducer carrier 30 in which a telemetry package and a plurality gauges are mounted. One or more accessory tools 24, such as a tubing nipple locator, a casing collar locator, or a gamma ray sensitive tool can be mounted below the carrier 30, and a drag spring valve 25 is located below the tools 24. The drag spring valve 25 is connected to the top of a selector valve or packer setting tool 26 which includes a hydraulic delay section 27. The lower end of the selector valve 26 suspends upper and lower inflatable packers 28 and 29 which are separated by a spacer nipple 2. Although the tool string 18 can be configured in other ways, the foregoing is exemplary where a well treating operation is to be performed.

The telemetry package and transducer carrier assembly 30 is shown in FIGS. 2A–2D. A threaded adapter sub 31 is screwed into the top of an upper tubular housing member 32. The upper sub 31 is formed with a depending, generally semi-circular tray 33 having upper and lower circular guide portions 34 and 35. The upper nose portion 36 of a hanger sub 37 threads into the bore of the lower guide portion 35, and the lower end of the sub 37 is threaded at 38 to the upper end portion of the housing 40 of a telemetry package indicated generally at 41. An insulated electrical lead 42 from the assembly 41 extends up through a central bore 43 in the hanger sub 37 and connects to a male connector member 44 that is seated and sealed in a counterbore 45 in the nose portion 36. Various additional seals, as shown, prevent fluid leakage into the telemetry package 41. The connector member 44 has an upstanding pin 47 which engages in the socket 48 of a female connector member 50 which is positioned in the guide 34 as shown. The connector member 50 is on the low end of an armored electric monocable 51 which extends up through the coiled tubing 19 to the surface as noted above. Although a single conductor cable 51 having a ground return via the outer armor wires is shown, of course a multiconductor armored cable can be used. Moreover the return current flow path could be via the coil tubing 19.

The telemetry package 41 is mounted inside the tubular housing 40, which is threaded at 49 to the upper end of a temperature transducer housing 50 as shown in FIG. 2B. The outer diameter of the housing 50 is substantially less than the inner diameter of the outer tubular housing member 32' to provide an annular fluid flow passage 51 therebetween. The tubular housing members 32 and 32' are threaded to an adapter sub 31' which is located adjacent the connection 49 for ease of assembly. The sensing element 46' of the temperature gauge 50 is exposed to fluids in the annular space 51 by ports 46, and thus senses the temperature of fluids flowing through the passage 51 near the lower end of the coiled tubing 19. A pressure gauge 52 is threaded at 59 to the lower end of the temperature gauge 50. As shown in FIG. 2C, the lower end portion 53 of the carrier housing section 54 is threaded to the upper end of a port sub 55 whose lower end is threaded to the upper end of the next lower carrier housing section 56 therebelow. The sub 55 has an inwardly thickened section 57 in which vertical and radial ports 58 and 60 are formed as shown in FIG. 3. The tubular gauge housing 61 fits snugly in the bore 62 of the sub 55, and seal rings 65 and 66 mounted on the housing 61 are employed to prevent communication between the radial ports 58 and the fluids in the passages 63, 58 and 69. The vertical ports 58 allow fluids pumped down the coiled tubing 21 to pass downward through the sub 55 between the annular spaces 63, 64, and the radial ports 60 extend through the walls of the sub 55 to communicate pressures in the well annulus outside the tool string with the pressure sensor element of the gauge 52 via the ports in the housing 61 as shown.

Another pressure transducer assembly 70 is threaded at 71 to the lower end of the pressure transducer 52 and extends downward within a housing section 72 to where its lower end portion 73 extends into a receiver sub 74 as shown in FIG. 2D. The sub 74 is threaded to the lower end of the housing section 72 at 75. The sub 74 has an integral internal sleeve 76 which forms a pocket 76' in which the lower portion 73 of the gauge 70 is received, there being an arcuate passageway 78 which bypasses such sleeve so that fluids can flow from the annular passageway 64 into the bore region 80 below the lower portion 73. The lower end of the receiver sub 74 is threaded at 77 to an adapter sleeve 82 having vertical ports 83 which lead upward to an annular space 84, a radial port 85, and an elongated upwardly extended port 86 which ends in an inwardly directed radial port 87. The port 87 communicates with a port 88 in the wall of the sensor section of the pressure transducer 70. Suitable seals 89 and 89' located on the housing 77 above and below the port 88 can be employed to ensure that pressures applied to the sensor port 88 are those in the passages and ports 83–87.

A mandrel 81 extends up inside the adapter sleeve 82 and the lower end portion of the sub 74 and is sealed with respect to these members as shown. The mandrel 81 which is threaded to the sub 74 at 81' forms the upper end portion of a back pressure valve assembly 90 which includes a spring loaded check valve (not shown). The details of the valve 90 form no part of the present invention and thus are not shown. The annular space 91 between the outer wall surface of the valve assembly 90 and the inner wall surface of the housing section 92 provides a path for fluid pressure to reach the ports 83–87 from a location in the housing 92 below the check valve assembly 90. The low end of the housing 92 is attached to an adapter sub 103 which is shown at the top of FIG. 4.

Figure 4:
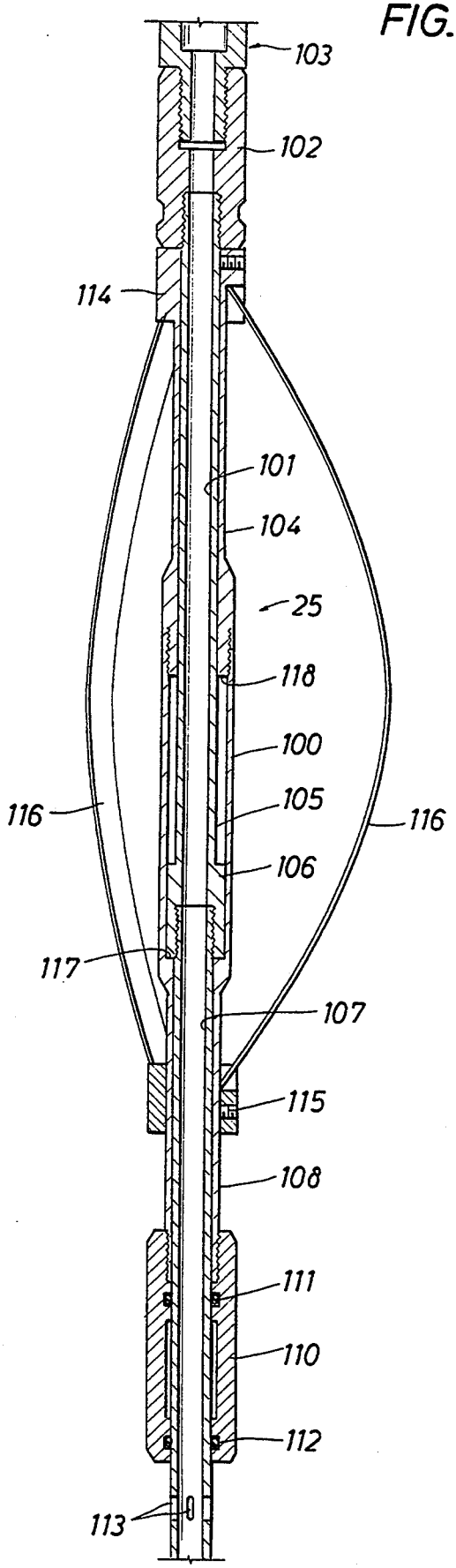
FIG. 4 is a longitudinal sectional view of the deflate/-drag spring valve.

Referring now to FIG. 4, the equalizing-deflate valve assembly 25 whose use in the tool string is optional includes an upper mandrel 101 having whose upper end is secured to an enlarged collar 102 that is threaded to the adapter sub 103. The mandrel 101 slides inside a housing 104 which defines an internal annular chamber 105. The mandrel 101 carries a stop shoulder 106 that can slide in such chamber between upper and lower positions. The stop shoulder 106 is threaded to a lower mandrel 107 which is surrounded by a lower housing 108. The housing 108 is connected by threads to the upper end of a tubular valve member 110 having spaced upper and lower internal seals 111,112 that slidably engage the lower mandrel 107. A friction drag assembly which enables circulation ports 113 in the mandrel 107 to be selectively opened and closed includes upper and lower heads 114, 115 which are connected to the ends of resilient bow springs 116 that in their relaxed states have a central diameter that is considerably larger than the inner diameter of the casing 10. The lower head 115 is movable relatively along the sleeve 108 so that the springs can retract to positions alongside the housing 100 where the drag tool 25 can pass through the tubing 12. Whether the springs 116 are inside the tubing 12 or the casing 10, they exert friction drag forces which retard longitudinal movement. During downward movement, the springs 116 hold the housing 100 in the upper position, as shown, where the circulation ports 113 in the mandrel 107 are open so that the tool string and coiled tubing can fill with fluids standing in the well. When the mandrel 101 is lifted upward, the springs 116 hold the housing 100 stationary so that the shoulder 106 moves up and engages the shoulder 118. In this position the valve sleeve 110 and the seal rings 111,112 span the ports 113 and closes same to prevent communication between the well annulus and the interior of the tool string.

Figure 5:
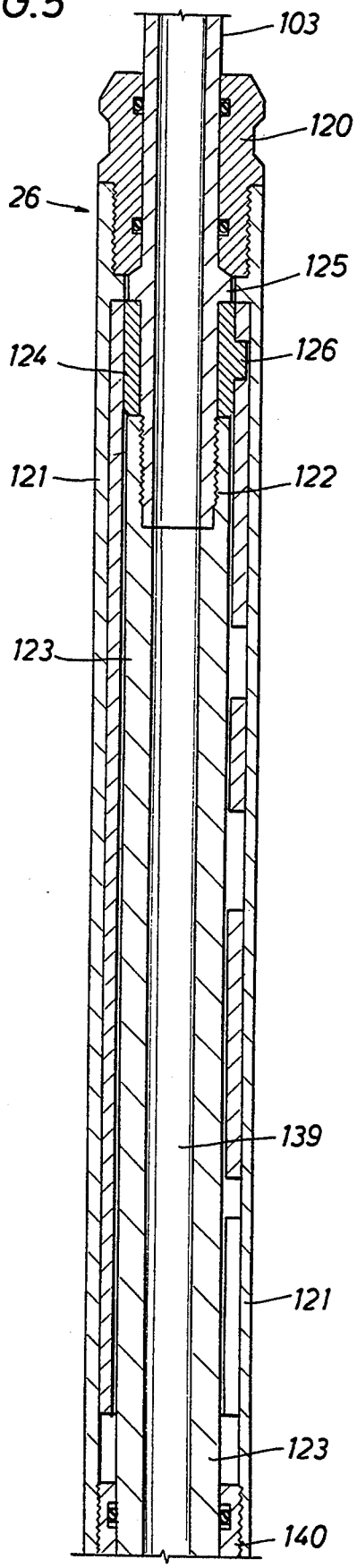
FIG. 5 is a longitudinal sectional view of the indexing portion of the selector valve assembly.
Figure 6:
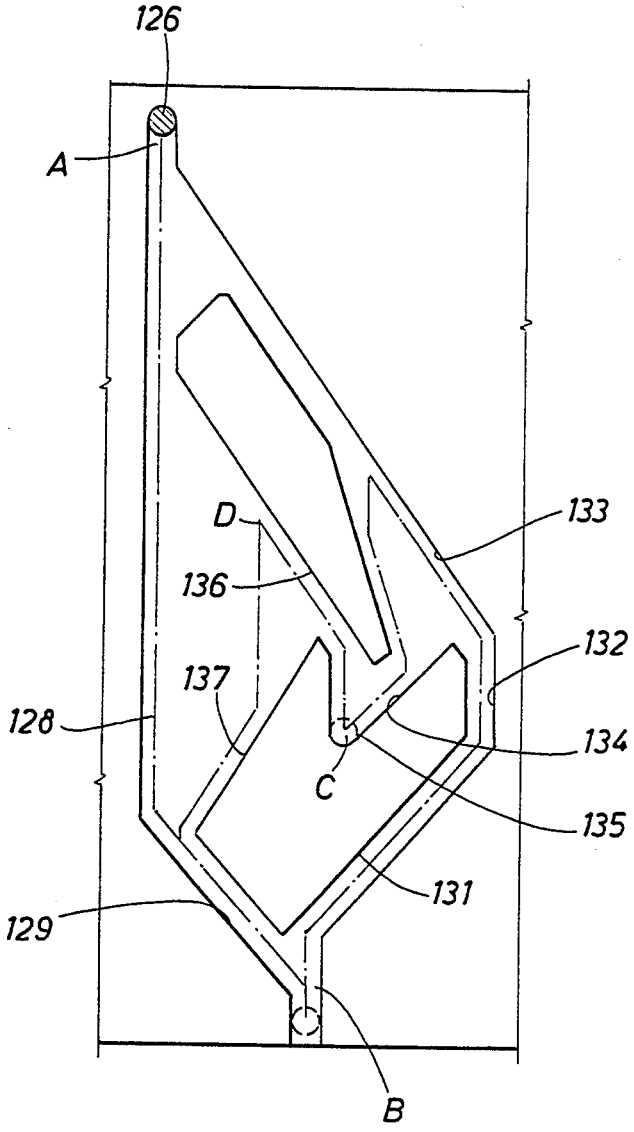
FIG. 6 is a developed plan view of the automatic jay-slot used in the valve assembly of FIG. 5.

The lower end of the mandrel 107 of the drag valve tool 25 extends into the upper end portion of the selector-setting tool 26 shown in FIGS. 5–9. The mandrel 107 extends through a sub 120 at the upper end of a tubular housing 121 and is connected at 122 to a mandrel 123 therein. A ring 124 which is rotatably mounted between a shoulder 125 and the upper end of the mandrel 123 carries a follower lug 126 which cooperates with a jay-slot system shown in FIG. 6 to control the longitudinal relative position of the inner mandrel 123 with respect to the housing 121, which, in turn, controls certain valve functions to be described below. Once the packers 28, 29 have been set so that the housing 121 is supported thereby, downward movement of the mandrels 107 and 123 causes the lug 126 to move downward through a vertical channel 128 formed on the inner walls of the housing 121, as shown in FIG. 6, until it engages an inclined channel 129. At this point the ring 124 rotates or indexes and the lug 126 moves into a lower pocket "B" where longitudinal movement is stopped. When the mandrel 123 is raised, the lug 126 automatically moves into and through the inclined channel 131 as the ring 124 again indexes, after which the lug moves upward through the short vertical channel 132 and into an oppositely inclined channel 133. When the mandrel 123 is again lowered, the lug 126 encounters the inclined channel 134 and moves into an intermediate pocket "C" where movement is stopped at a different longitudinal relative position. Then if the mandrel 123 is raised and then lowered, the lug 126 automatically moves up the inclined channel 136 as the ring 124 indexes, and then down the inclined surface 137 which leads to the first inclined channel 129 and thus to the lower pocket "B". If raising of the mandrel 123 had been continued while it was in the inclined channel 133, the lug 126 would have moved back up to the starting pocket "A". The paths of movement of the lug 126 are shown in phantom lines in FIG. 6. The automatic jay-slot tool 26 has a central open bore 139 through which fluids from the coiled tubing can pass when the ports 113 of the drag valve sleeve 110 (FIG. 4) are closed.

Figure 7:
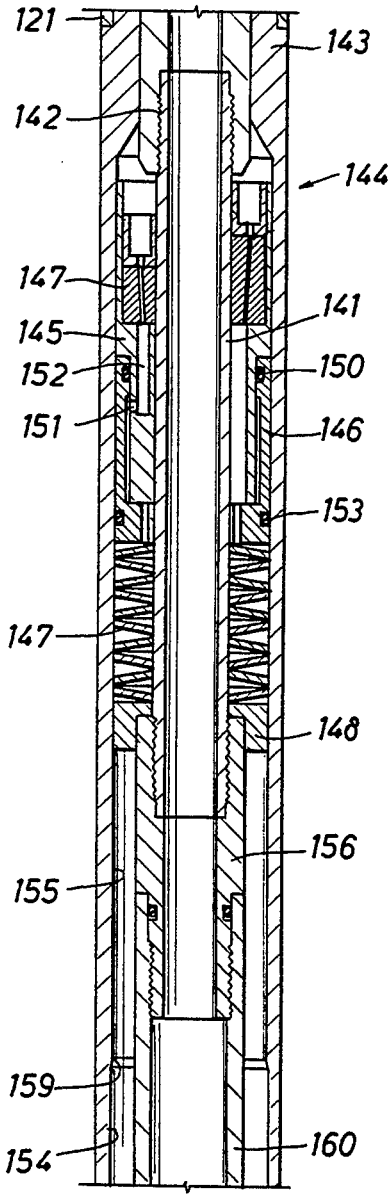
FIG. 7 is a longitudinal sectional view of the hydraulic delay portion of the assembly shown in FIG. 5.

A hydraulic time delay assembly 27 which is shown in FIG. 7 forms a lower extension of the jay-slot tool 26. The assembly 27 includes a tubular housing 140 and an inner tubular mandrel 141 that are connected as shown to the respective lower ends of the housing 121 and mandrel 123 of the automatic jay mechanism 26. The housing 140 has an upper, reduced inner diameter portion 155 that extends downward to a point 159 where the inner diameter thereof is enlarged somewhat to provide a lower enlarged inner diameter portion 154. A delay piston assembly 144 is secured to the upper portion of the mandrel 141, and includes a head 145 having a close tolerance fit in the reduced diameter portion 155. The head 145 carries a plurality of fluid flow control devices 147, as disclosed in further detail in U.S. Pat. No. 4,913,231. The assembly 144 includes a sleeve valve member 146 which is biased toward the head 145 by springs 147 which are mounted on an outwardly directed shoulder 148 on the mandrel 141. The valve member 146 carries an upper seal ring 150 that normally is above a lateral port 151 which leads to a longitudinal port 152 in the head 145, and a lower seal ring 153 which engages the wall of the reduced diameter housing section 155. The delay assembly 27 is oil-filled in the known manner. When a differential pressure of a predetermined magnitude is imposed across the valve sleeve 106, the force of the springs 147 is overcome and the valve sleeve moves downward to isolate the port 151 and thus the orifice assembly 147. The orifice assembly 147 provides two rates of damping because the shifting of the valve sleeve 146 does not affect some of its orifices. Thus when both sets of orifices are open, the mandrel 141 can move faster relative to the housing 140 in the downward direction, whereas when only one set of orifices is open the mandrel can move only very slowly in the upward direction. When the piston assembly 146 moves downward into the enlarged diameter housing portion 154, substantial clearance is provided so that the piston assembly 146 and the mandrel 141 can move freely. However when the mandrel 141 is raised so that the piston assembly 146 enters the reduced diameter cylinder portion 155, damping again is provided to prevent rapid upward movement of the mandrel 141. The lower end of the mandrel 141 is coupled by an adapter 156 to a tubular valve member 160 which extends downward within the housing 140.

Figure 8:
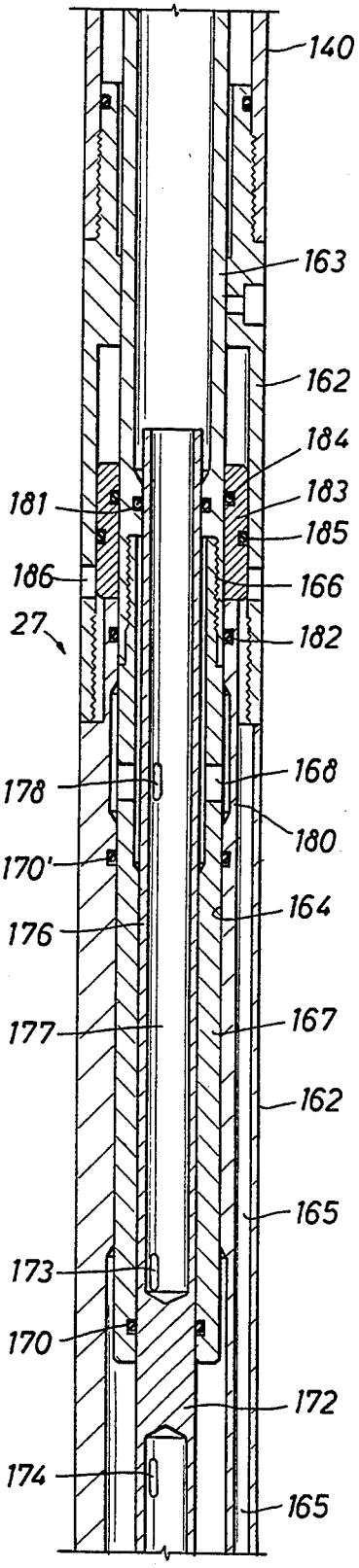
FIGS. 8–10 are sectional views showing various operating positions of the selector valve assembly.
Figure 9:
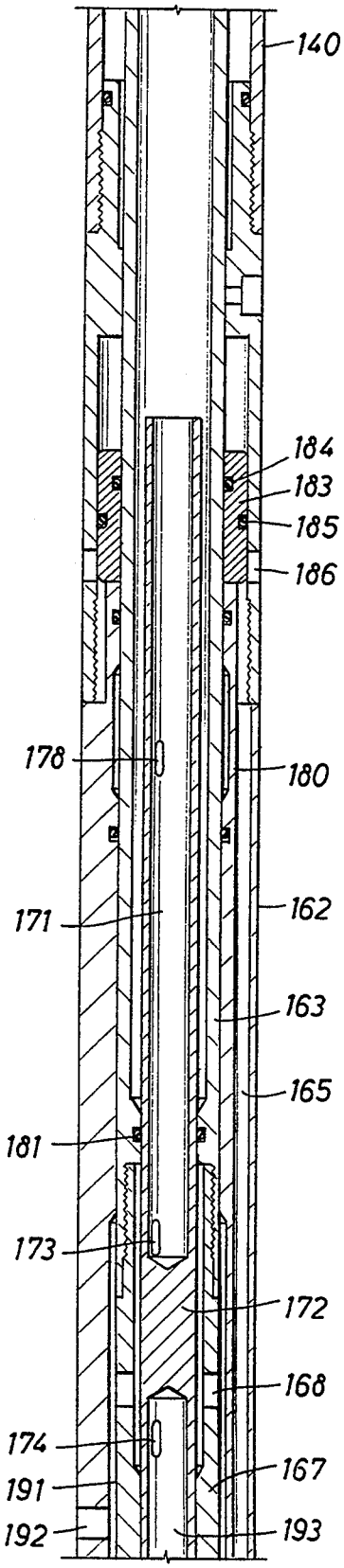
Figure 10:
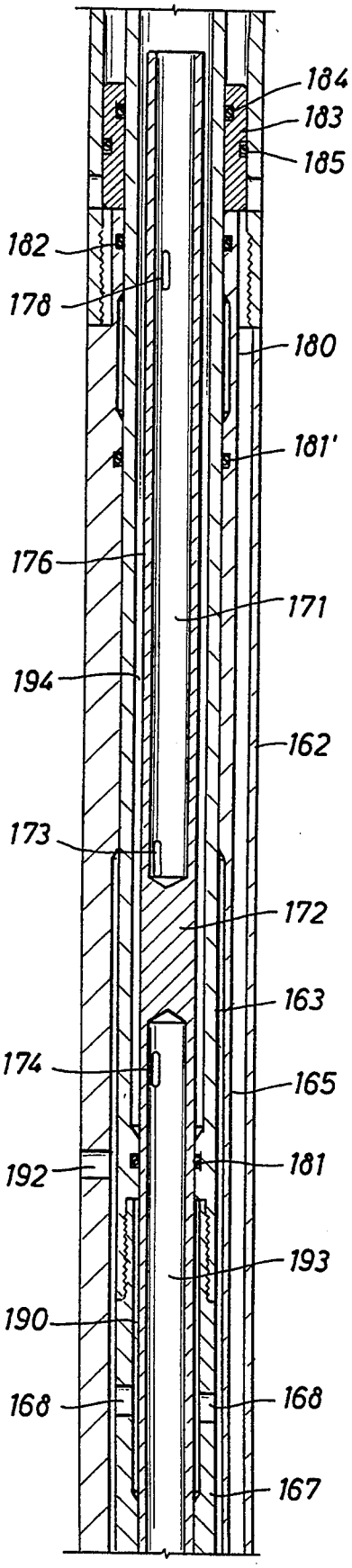

FIGS. 8–10 illustrate the various operating positions of the selective flow valve mechanism 27 included in the packer setting tool assembly 26. The valve mechanism 27 includes a housing member 162 which is connected to the lower end of the delay housing 140 and which receives the lower end portion 163 of the mandrel 160 of the hydraulic delay assembly 144. The housing member 162 defines a central bore 164 and a laterally offset, separate packer inflation passage 165. The end portion 163 of the mandrel 160 is threaded at 166 to a valve sleeve 167 that has lateral flow ports 168 and carries a seal ring 170 near its lower ends. An upstanding flow tube 176 is mounted centrally in the housing 162 and has an upper bore 171 that is open down to a barrier 172, and a lower bore 193 therebelow. Lateral flow ports 173 and 174 are provided respectively above and below the barrier 172.

The flow tube 176 extends up inside the bore 177 of the valve sleeve 167 and partly up into the lower end of the mandrel 163. The tube 176 has additional lateral flow ports 178 which are located opposite the ports 168 in the position of the valve assembly shown in FIG. 8. A port 180 connects the inflation passage 165 with the ports 168 and 178 and the open bore 171 of the flow tube 176 to enable inflation of the packer elements 28, 29 in the position of parts shown in FIG. 8. A seal ring 181 prevents leakage between the mandrel 163 and the flow tube 176, and a seal 182 prevents leakage between the valve sleeve 167 and the bore 164 of the housing 162. Another seal 170' seals between the valve sleeve 167 and the bore wall 164.

A compensating piston 183 is movable between the housing 162 and the mandrel 163 and carries inside and outside seal rings 184, 185. The lower side of the piston 183 is in communication with the well annulus via ports 186. The piston 186 can move in order to compensate for changes in volume of hydraulic fluid in the delay section 144 due to downhole changes in temperature and pressure.

To inflate the packer elements 28, 29 and thereby isolate a zone of the well bore, fluids under pressure are pumped into the coiled tubing 19 at the surface which causes flow through the annular passageways 51, 63, and 64 in the instrument housing 32, 54, 56, and thence through the bore of the mandrel 81 and through the open bores of the drag tool 25, the automatic jay mechanism 26, the hydraulic delay 144, and into the bore 171 of the valve tube 176. From there the fluids pass out through the ports 178, 168 and 180 and into the inflation passage 165 which leads to the respective interiors of the inflatable packer elements 28, 29. These fluid pressures also pass through the space 91 and the ports 83–88 where they act on the pressure sensor in the sub 70, and thus can be read out at the surface as will be described below. While holding the desired inflation pressure on the packers 28, 29, the coiled tubing 19 is picked up at the surface and placed in tension to ensure that the packers are set, as will be shown on the weight indicator 6.

FIG. 9 shows the valve assembly 27 with the valve sleeve 167 moved downward along the flow tube 176 to the circulating position in response to lowering of the coiled tubing 19 after the packers 28, 29 have been inflated and set. The seal ring 181 now is positioned below the upper radial flow ports 178 and above the radial flow ports 173 which are above the barrier 172. Fluids pumped down the coiled tubing 19 now can pass out of the ports 173, through the annular passage 190, out the ports 168, through the annular passage 191 and out the housing ports 192 into the well annulus. Such circulation enables the well fluids in the tubing 19 and tool string 18 to be displaced by a treating fluid until the lower end of the column of such fluid is adjacent the packers 28 and 29. Annulus pressures are sensed by the transducer inside the housing 61 via the ports 60 at all times.

FIG. 10 shows the relative position of the selector valve parts when treating fluids are being injected into the interval that is isolated by the packers 28, 29. Here the valve sleeves 163 and 167 have been lowered further until the seal ring 181 is below both the barrier 172 and the lower radial ports 174. In this position the circulating ports 192 are closed off from communication with the lower bore 193 of the flow tube 176 by the seal rings 181 and 170 (FIG. 8). Treating fluids now can be pumped down the tubing 19 flow past the barrier 172 via the annular space 194, and then through the ports 174 and into the bore 193. From there the fluids flow down through the body of the upper packer 28 and out the injection ports 213 into the isolated zone.

Figure 11:
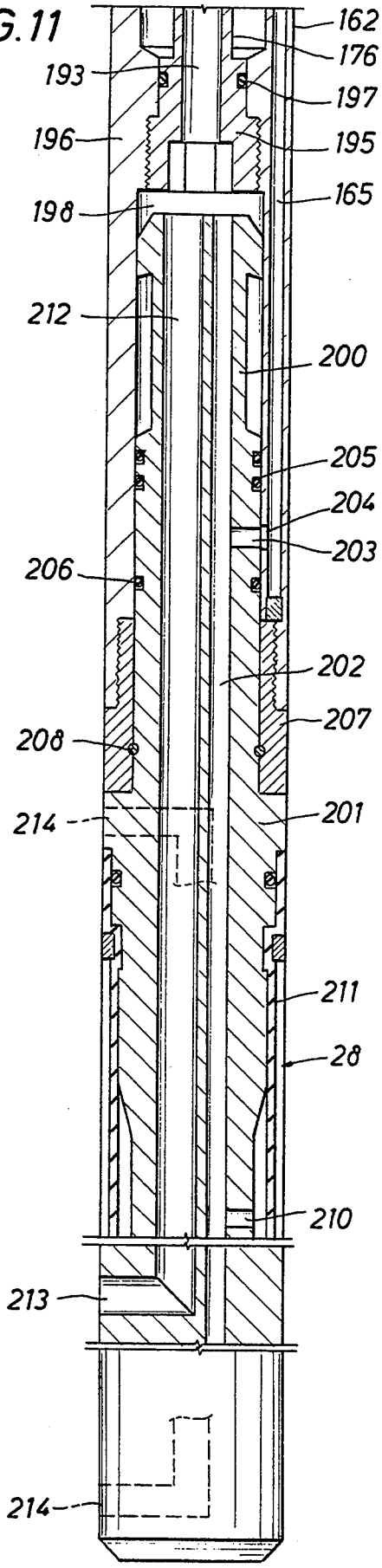
FIG. 11 is a sectional view of the packer section of the tool string.

As shown in FIG. 11, the lower end of the flow tube 176 is mounted by a fixture 195 in a lower portion 196 of the housing member 162. A seal ring 197 prevents fluid leakage. An internal chamber 198 in the housing portion 196 receives a connector head 200 at the upper end of the body member 201 which mounts the packer assemblies 28, 29. The head 200 defines an injection passage 212 and an inflation passage 202. The passage 202 communicates with a radial port 203 which leads to the inflation passage 165 via port 204. Seals 205 and 206 prevent leakage. The lower end of the housing 162 is provided with a collar 207 which can be secured to the connector head 200 by tangential shear pins 208 or the like to provide a releasable connection in the event the packers 28, 29 should get stuck in the well bore. The upper end of the connector head 208 provides a fishing neck for that purpose.

Only the upper portion of the packing element 28 is shown in FIG. 11 since the details of construction of inflatable packers is generally well known. The lower packer element 29 is identical to the upper packer 28 and also is not shown. The inflation passage 202 leads to a port 210 that communicates with the interior of an elastomer sleeve-like structure 211 whose upper end is fixed and sealed against the body member 201. The lower end of the sleeve structure 212 also is sealed against the body member 201, but can be arranged to move upward as the structure expands. The inflation passage 202 also leads down to a port which communicates fluid under pressure to the lower packer element 29 (FIG. 1). The injection passageway 212 extends down in the body member 201 to one or more side ports 213 through which treating fluids are injected into the well interval that is isolated by the packers. A separate equalizing passage 213 which extends from below the lower packer 29 up through the body member 201 to a port 214 located above the upper packer element 28 functions to communicate the pressure of fluids below the lower packer 29 with those in the annulus above the upper packer 28 at all times.

Figure 12:
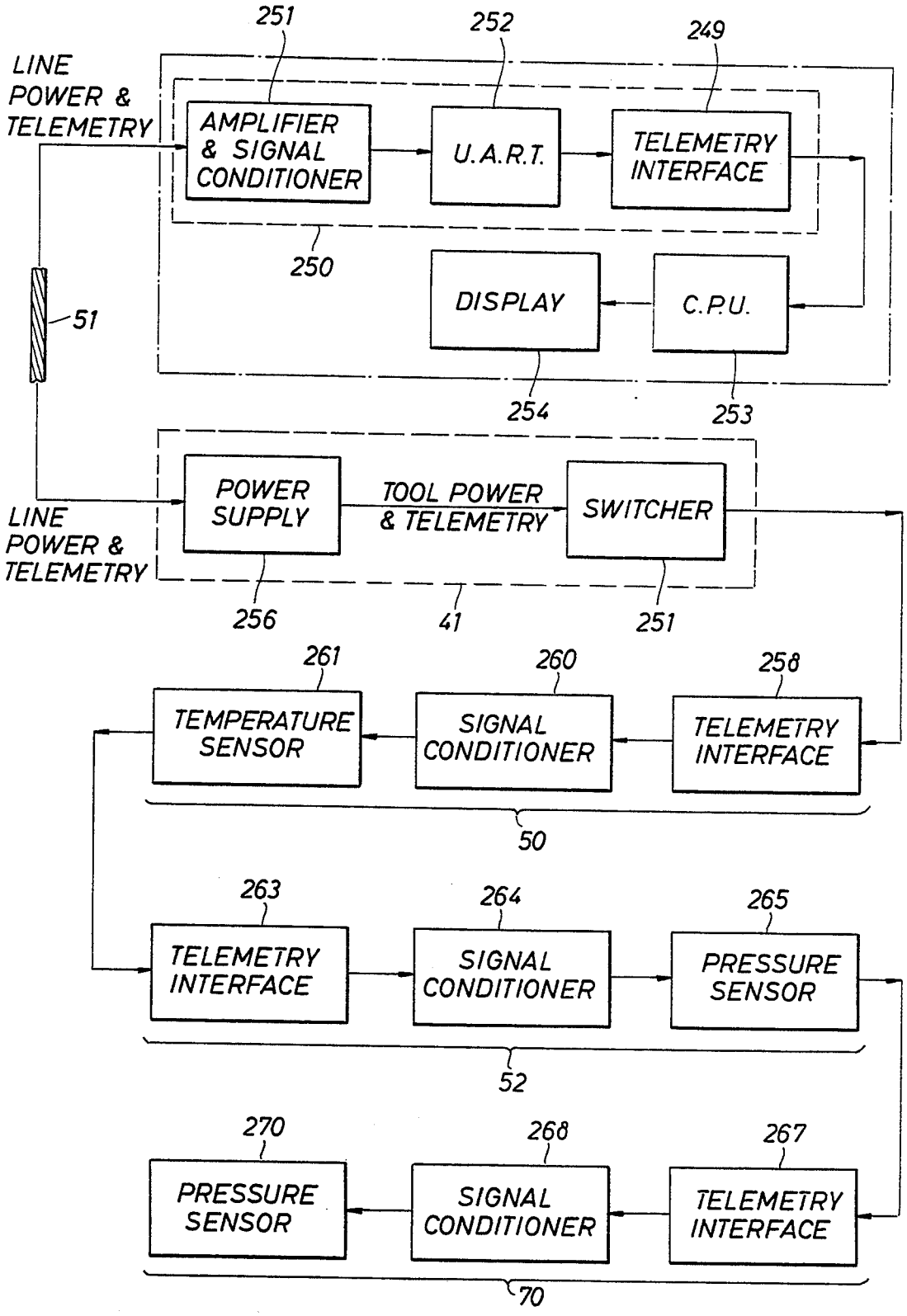
FIG. 12 is a schematic block diagram of the transducers, telemetry and other related components of the present invention.

A functional block diagram of the surface and downhole components which enable the pressure and temperature measurements to be read out at the surface in real time is shown in FIG. 12. The surface equipment comprises a telemetry module 250 having an amplifier and signal conditioner 251, a universal asynchronous receiver/transmitter (UART) 252 and a telemetry interface 249. The balance of the surface components includes a central processing unit (CPU) 253 and a display 254. This system employs a baseband telemetry technique where binary encoded commercial and data packets with error checking are used to communicate with the downhole telemetry sub 41 via the armored electric cable 51 and to obtain surface readouts of the measurements made by the temperature transducer sub 50 and the pressure transducer subs 52 and 70.

The downhole measurement and telemetry components which receive line power and signals via the armored cable 51 include a power supply 256 and a switcher 257 in the telemetry sub 41. The switcher 257 is connected to a telemetry interface 258, a signal conditioner 260 and a temperature sensor 261 housed in the sub 50. The sensor 261 can be a platinum thermocouple or the like. The pressure reading sub 52 also includes a telemetry interface 263, a signal conditioner 264, and a pressure sensor 265 which can be, for example, a strain gauge mounted on an atmospheric chamber wall that is deformed in proportion to pressure differential. The pressure measuring sub 70 includes essentially the same components as the sub 52, namely a telemetry interface 267, a signal conditioner 268 and a strain gauge pressure transducer 270. The subs 52 and 70 enable the measurement of a combination of outside and inside pressures as well as packer inflation pressures.

OPERATION

The string tool 18 is assembled as shown in the drawings and run into the well through the production tubing 12 on the lower end of the coiled tubing 19. The electrical conductor cable 51 will have been positioned inside the coiled tubing 21 prior to the time it was wound on the reel 20. The cable 51 can be an armored monocable (single center conductor) or an armored multiconductor cable, as desired. The waterproof connector 50 is terminated on the outer end of the cable 51, and is connected to the companion male connector 47 at the upper end of the conductor 42 which connects to the telemetry sub 140. The upper end of the cable 51 is brought out through a packing gland on the outer end of the coiled tubing, and leads to the telemetry module 250 at the surface. Although other combinations of measurements can be made, the transducer 52 measures annulus pressure above the upper packer element 28, which will be approximately the same as the pressure below the lower packer 29 on account of the equalizing passage 214, and the other pressure transducer measures pressures inside the tool string 10, which reflect inflation pressures during packer setting, as well as injection pressures during the treating operation. The transducer 50 measures the temperature of fluids inside the tool string 18 which is useful in calculating packer and injection pressures.

As the tool string 18 is lowered, the frictional resistance to downward movement afforded by the bow springs 116 on the drag valve 25 maintains the valve sleeve 110 in its upper or open so that the tubing 19 fills with liquids through the ports 113. The time delay means 144 and the selector valve assembly 26 remain in their fully extended positions as shown in FIGS. 5 and 7 where the lug 126 on the follower ring 124 is positioned in the upper pocket A as shown in FIG. 6. The valve ports 113, 178, 168 and 180 are open to the inflate/deflate passageway 165, so that the packers 28, 29 remain deflated and retracted. When the drag tool 23 is positioned below the lower end of the production tubing 12, the springs 116 resile further outward and engage inner walls of the casing 10 so that they continue to provide frictional restraint.

At the general depth in the casing 10 where a treating operation is to be performed, the tool string 18 is halted a few feet below such depth, and then raised back upward about the same distance. This causes the drag mandrel 101,107 to move upward relative to the springs 116 and the valve sleeve 110 which closes off the ports 113. Fluid then is pumped down the coiled tubing 19 and through the various inflation passages and ports including 178, 168, 180, 165, 203, 202 and 210 and into the interior of each inflatable packer element 28, 29. As such pressure is increased, the elastomer packer elements 211 expand outward until their outer peripheries sealingly engage the surrounding walls of the casing 10 to pack off the upper and lower ends of the treatment zone. The transducers 52 and 70, together with the telemetry cartridge 40, the conductor cable 51 and the surface components 250, 253 and 254 provide real time read-outs at the surface of the hydrostatic pressure in the annulus, the inflation pressures applied to the packers 28, 29 and the treating fluid pressure applied to the isolated zone via the ports and passages 173, 190, 174, 193,212 and 213. Pressures inside the tool string involved in circulating through the port 192 to spot treating fluids also can be read out at the surface. The transducer 50 provides a surface reading of downhole temperature which is useful in connection with packer setting pressure determinations.

To verify that the packers 28 and 29 have in fact been inflated, the operator can cause the traction system 8 at the surface to pull upward on the coil tubing 19, which should result in an increase in the reading of the weight indicator gauge 6. Once setting of the packers is verified, it may be desirable to test the isolated zone to determine if the formation 16 will take fluids. For this purpose, the coiled tubing 19 is lowered so that the selector valve mandrel 163, 167 moves downward within housing 12 as shown in FIG. 9 as the follower lug 126 on the ring 124 moves into the lower pocket "B". During this movement of the mandrel 163, 167 the inflate/deflate passages continue to be closed off so that inflation pressures are trapped within the packers 28, 19. This position also communicates the coiled tubing 19 with the isolated zone via the injection ports 213 and the ports and passages 194, 174, 193 and 212, so that pressure can be applied to the formation 16 to determine if it will accept fitlids, and at what pressures. Hereagain the inside pressure sensitive transducers 70 make measurements which are transmitted to the surface so that they can be read out in real time.

At the completion of the injection testing phase of the operation, treating fluid is spotted as follows. The traction device 8 is operated to raise the valve mandrel 165 relative to its housing 162. Initially, there is an amount of free travel that occurs as the piston head 146 in the damper assembly 144 moves up the enlarged diameter lower cylinder portion 154. However when the piston assembly 146 enters the reduced diameter cylinder portion 155, restricted flow retards upward movement so that several minutes are required for the damper assembly 144 to become fully extended as shown in FIG. 7. The resistance to further upward movement of the tubing 19 provides a surface indication of the sequence of operation. During a specified short time of continued upward pull, during which movement of the piston 146 is restricted, the follower lug 126 moves up the channel to the position "D". Then the operator decreases the tension applied to the tubing 19, which causes the follower lug 126 to move down along the channel 134 to the pocket "C". In this intermediate position of the valve mandrel 163 the ports 173 on the valve tube 176 are below the seal 181 to permit circulation to the annulus via the ports and passages 168, 190 and 192 as shown in FIG. 9. Chemicals now can be spotted by pumping them down the tubing 19 to cause standing fluids to flow to the annulus via the ports 173, 168 and 192, all of which are open to the annulus. Pumping is stopped when the leading edge of the spot fluids is at or near the upper end of the tool string 19.

To inject the fluids into the formation 26, the operator increases the tension on the tubing 19 to raise the follow lug 126 out of the pocket "C" until it moves past the position indicated at "D" in FIG. 6. Such tension is not maintained for more than about two minutes to ensure that the valve 27 does not move back to the inflate/deflate position. The tubing 19 then is lowered to cause the follower lug 126 to move down along the channel surfaces 137 and 129 and back to the lower pocket "B". This relative movement positions the valve 27 for injection, and a weight indication that is less than run-in weight confirms that the packers 28 and 29 are still set. The spotted treatment fluid then is pumped down the tool passages and injected via ports 213 into the isolated zone between the packers 28, 29 where it enters the formation 16 through the perforations 15. Injection pressures are monitored continuously by the inside-reading gauge 70 and transmitted to the surface as described above.

When treating fluid injection has been completed, the surface pump 4 is shut down and the traction unit 8 is operated to cause the follower lug 126 to move up along the channel 131, FIG. 6. When the dampener piston 146 moves into active position, tension is maintained on the tubing 19 for more than about three minutes, so that the follower lug 146 moves all the way back to the upper pocket "A", at which point the inflate/deflate passage 165 is opened. This enables the packers 28, 29 to deflate and inherently retract, which can be confirmed by observing a decrease in weight indicator reading at the surface.

Surface readings of the downhole measurements of pressure and temperature are obtained as follows. Communication is initiated by the surface telemetry package 250 which sends a binary encoded command signal to the downhole telemetry sub 41. The command signal can be addressed to one of the two pressure transducers 52 or 70, the temperature transducer 50 or the telemetry sub 41. Whichever component has been addressed by the command signal responds to the surface telemetry package 250 with a reply signal that also is binary encoded. The power supply in the telemetry sub 41 regulates line power on the cable 51 and passes communication signals through to a particular transducer sub 50, 52 or 70.

The telemetry system 250 at the surface samples each of the downhole transducers every 100 milliseconds, for example, during normal operation. Sampling rates may differ during initialization. The data signals received from the downhole transducers 50, 52 and 70 are stored in memory by the CPU 253. The surface electronics performs averaging and noise rejection before passing the data on to other recording equipment and the interference module 249. The module 254 is the display unit that plots the data for the operator to observe for trends in the downhole measurements.

When a particular operation is completed, the packers are deflated so that the tool string 18 can be moved to another location in the casing 10 where another operation is to be performed, or the tool string can be removed from the well by winding the tubing 19 back onto the reel 20. At all stages in the operation of the tools, a read-out of pressures and temperature is available in real-time at the surface. From such readings the inflatable packer pressure differentials can be determined, and operational adjustment can be made at the surface to maintain such differentials within design limits. The response of the formation rock to the treatment can be monitored which allows real-time adjustment of treatment pressures to optimize the results. Although pressures and temperatures are disclosed as those variables being measured and monitored as disclosed herein, it is clear that numerous other measurements could be made, such as casing collar and tubing nipple locations, or any other well data or characteristic properties which are susceptible to measurement. Since certain changes or modifications may be made in the disclosed embodiments without departing from the inventive concepts involved, it is the aim of the appended claims to cover all such changes and modifications falling within the true spirit and scope of the present invention.

What is claimed is:

1. A well treating system where downhole variables such as pressure and temperature are made available at the surface in real time, comprising: a tubular body adapted to be lowered into the well on a running string; inflatable packer means on said body for isolating a zone of the well; valve means operatively associated with said body for allowing packer inflation, fluid circulation, fluid injection and packer deflation; a plurality of transducers in said body for sensing said variables and providing signals representative thereof; transmission means connected to each of said transducers and including switching means for sampling the output of each of said transducer means; electrical conductor cable means extending through said running string from the surface to said telemetry means; and means connected to said cable at the surface for processing said signals and providing a real time display of each of said variables.

2. The system of claim 1 wherein said running string is coiled tubing wound on a reel and arranged to be run into and out of the well by traction means, said conductor cable extending throughout the entire length of said coiled tubing and being positioned therein prior to storage of said coiled tubing on said reel.

3. The system of claim 2 further including electrical connector means at the lower end of said conductor cable arranged to mate with electrical connector means at the upper end of said telemetry means.

4. The system of claim 3 wherein said transducers are mounted end-to-end in housings mounted within said body; first passage means for communicating one of said transducers with fluid pressures in the well annulus externally of said body; and second passage means for communicating another of said transducers with pressures inside said body.

5. The system of claim 4 wherein another of said transducers includes sensor means for measuring the temperature of fluids in said body.

6. A method of treating a well zone with a tool string run on coiled tubing and providing a surface read out of at least one downhole measurement during said treating, comprising the steps of: positioning an electrical conductor throughout the length of said coiled tubing; placing said coiled tubing on the reel of a coiled tubing unit; bringing said conductor to the outside of the inner end of said coiled tubing where said conductor can be hooked up to a read-out device; connecting the outer end of said coiled tubing to a tool string that can be operated downhole to isolate the zone to be treated; electrically connecting the outer end of said conductor to transducer means for making said measurement; lowering said tool string into the well on said coiled tubing and operating said tool string to isolate said well zone; performing a treating operation in said well zone; making a measurement with said transducer means in connection with said treating operation; and obtaining a surface read out of said measurement via said conductor.

7. The method of claim 6 wherein said measurement is of the pressure of fluids in said isolated zone.

8. The method of claim 6 wherein said measurement is of the hydrostatic pressure of fluids in the well bore above said isolated zone.

9. The method of claim 6 wherein said measurement is of the temperature of fluids within said tool string.

10. The method of claim 6 wherein said tool string includes upper and lower inflatable packers for isolating a zone of a well bore, and wherein said measurement is of the inflation pressure applied to said packers.

11. The method of claim 10 wherein said measurement is the pressure of fitlids in said isolated zone.

12. A well treating system including a tool string having inflatable packer means and adapted to be lowered into a well on a running string, said tool string including: an elongated tubular housing; a plurality of transducer means and a transmission sub mounted end-to-end in said housing; means for transmitting measurements made by said transducer means upward to the surface through said running string; means providing a flow passage space between the exterior of said transducer means and said transmission sub and the inner walls of said housing to enable fluids to flow past said transmission sub and transducer means; means included in one of said transducer means to measure a property of said fluid in said flow space; and port means in said housing adjacent another of said transducer means for communicating fluids in the well bore externally of said housing to said other transducer means to enable measurement of a property of fluids externally of said housing.

13. The system of claim 10 wherein said housing includes receiver means adjacent the lower end thereof, the lower one of said transducer means having a lower portion thereof extending into said receiver means and including port means; and further including passage means communicating said port means with the interior of said housing below said lower transducer means.

14. The system of claim 10 wherein a third one of said transducer means includes means for measuring the temperature of fluids in said passageway.

15. The system of claim 10 wherein said transmitting means includes a sub which is connected to each of said transducer means by switching means to enable consecutive sampling of the measurements made thereby; and wherein said transmission means includes means for providing an output signal which is representative of said sampling when said sub receives a command signal from the surface.

16. The system of claim 15 further including means at the surface for processing said signals received from said sub and for displaying values of each of said measurements.

17. The system of claim 15 wherein said transmitting means includes a conductor cable that extends from said transmission sub to the surface through said running string, and wherein said command signal is a binary encoded command signal sent down said conductor cable and which is addressed to said transducer means.

18. The system of claim 17 including the further step of causing said transducer means to respond to said command signal with a reply signal that is binary encoded to represent a measurement made by said transducer means.

19. The system of claim 18 including the further step of transmitting said encoded reply signal to the surface via said conductor cable.

20. The system of claim 19 including the step of storing said reply signal in a memory.

21. The system of claim 19 wherein said sending and causing steps are performed repeatedly in a sequential manner; and including the further steps of recovering noise signals and averaging the data represented by said reply signals.

22. The system of claim 21 including the further steps of recording the data signals and plotting same to provide a visible display of said data and any trends in the values thereof.

* * * * *